United States Patent [19]

Sayles

[11] Patent Number: 4,463,680

[45] Date of Patent: Aug. 7, 1984

[54] METHOD OF GENERATING SINGLE-EVENT, UNCONFINED FUEL-AIR DETONATION

[75] Inventor: David C. Sayles, Huntsville, Ala.

[73] Assignee: The United States of America as represented by the Secretary of the Army, Washington, D.C.

[21] Appl. No.: 423,574

[22] Filed: Sep. 27, 1982

[51] Int. Cl.[3] ..... F42B 13/00

[52] U.S. Cl. ..... 102/363

[58] Field of Search ..... 102/363; 149/19.2, 22

[56] References Cited

U.S. PATENT DOCUMENTS

| | | | |
|---|---|---|---|
| 3,570,401 | 3/1971 | Euker | 102/363 |
| 3,596,603 | 8/1971 | Gryting | 102/363 |
| 4,157,928 | 6/1979 | Falterman et al. | 102/363 |
| 4,293,314 | 10/1981 | Stull | 102/363 |
| 4,302,208 | 11/1981 | Wood et al. | 102/363 |

*Primary Examiner*—Charles T. Jordan

*Attorney, Agent, or Firm*—John H. Raubitschek; Arthur I. Spechler; Jack W. Voigt

[57] ABSTRACT

Unconfined detonation by a single-event process is achieved by simultaneous dispersion of both fuel and the initiating chemical catalyst into the atmosphere. The fuel is selected from a volatile liquid (lower molecular weight, alkanes, epoxyalkanes, etc.), aluminum, boron, etc. or mixtures thereof. The initiating chemical catalyst is selected from n-hexylcarborane, carboranylmethyl propionate, ferrocene, n-butylferrocene etc. The fuel and initiating chemical catalyst are dispersed simultaneously to form a cloud after the catalyst is premixed with the fuel and housed in a container prior to dispersion. The dispersed catalyst catalyzes the reaction between fuel and atmosphere oxygen to produce the explosive oxidation of the fuel-air mixture.

Additional enhancers for detonability such as a bis(difluoroamino) compound (TVOPA) and/or ultrafinely-ground ammonium perchlorate are included in the fuel-catalyst mixture when the unconfined detonation is to be achieved in an oxygen-deficient atmosphere.

4 Claims, 2 Drawing Figures

METHOD OF GENERATING SINGLE-EVENT, UNCONFINED FUEL-AIR DETONATION

DEDICATORY CLAUSE

The invention described herein may be manufactured, used, and licensed by or for the Government for governmental purposes without the payment to me of any royalties thereon.

BACKGROUND OF THE INVENTION

A two-event process for the explosive detonation of a fuel-air mixture in the atmosphere consists of, first, dispersing the fuel, and second, detonating the fuel-air dispersed mixture. Presently, the method of initiating an unconfined fuel-air cloud is by means of a solid explosive charge.

The mechanism of fuel-air explosion includes primary detonation in the fuel-air explosive system to disperse the fuel into the surrounding atmosphere. The primary detonation in this manner forms a cloud of atomized fuel and generates a strong primary air shock. The oxygen carried into the cloud by air entrainment reacts instantly with the fuel, and increases the cloud's momentum, thereby generating the fuel-air explosive effect.

Several approaches to reduce a two-event process for the explosive detonation of a fuel-air mixture to a single-event process have been investigated. One single-event process investigated has been directed to initiation of detonation by free radicals (gaseous fluorine, bromine/-chlorine trifluoride, etc.) as accelerator located in the midst of a hydrocarbon-air mixture, trimethylaluminum subjected to pulsed ultraviolet and continuous ultraviolet light.

A single-event process which simultaneously disperses a fuel-catalyst mixture to achieve an unconfined fuel-air cloud explosion following a dispersion and induction period would be advantageous over previously investigated processes.

An object of this invention is to provide a single-event process for dispersing and detonating a fuel-catalyst mixture to achieve an unconfined fuel-air cloud explosion.

Another object of this invention is to provide a single-event process for dispersing and detonating a fuel-catalyst mixture to achieve an unconfined fuel-air cloud explosion following a controlled induction period which is the time from the time of dispersion to the time of explosion that is controlled by the amount of catalyst dispersed in the fuel-air cloud.

SUMMARY OF THE INVENTION

The unconfined detonation by a single-event process in accordance with this invention procedure comprises preparing a fuel-catalyst mixture of a fuel selected from a volatile liquid of a lower molecular weight alkane or epoxyalkane, aluminum powder or boron powder, and an initiating chemical catalyst selected from n-hexylcarborane, carboranylmethyl propionate, ferrocene, and n-butylferrocene. The fuel-catalyst mixture is housed in a container and dispersed using a conventional explosive charge.

Upon dispersion and following an induction time period which is the time from the time of dispersion to the time of explosion, the ferrocene or carborane catalyzes the interaction of oxygen (from air) and the fuel producing a single-event detonation when the detonation takes place in an oxygen-sufficient atmosphere. The fuel-catalyst mixture additionally contains an oxygen source when the detonation is achieved in an oxygen deficient atmosphere.

DESCRIPTION OF THE PREFERRED EMBODIMENT

Figure 2:
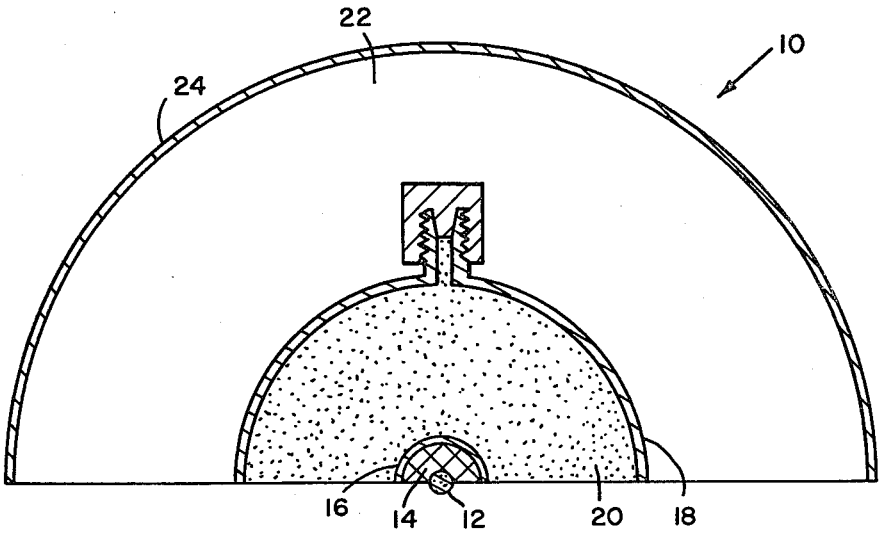
FIG. 2 is a sectional view along line 2—2 of FIG. 1 and partially cut-away.

The method of generating a single event, unconfined fuel-air detonation employs a prepared fuel-catalyst mixture housed in a container. The fuel is selected from a volatile liquid of a lower molecular weight alkanes or epoxyalkanes, aluminum powder or boron powder or mixtures thereof. The initiating chemical catalyst is selected from n-hexylcarborane, carboranylmethyl propionate, ferrocene, and n-butylferrocene.

The procedure for preparing the fuel-catalyst mixture involves dissolving from 2–10% of the selected catalyst in the selected fuel which is housed in a container. The fuel-catalyst mixture is dispersed into the atmosphere using a conventional explosive charge.

Upon dispersion, the ferrocene or carborane catalyzes the interaction of oxygen (from air) and the fuel producing a single-event detonation. There is an induction period from the time of dispersion to the time of the explosion which can be controlled by the amount of ferrocenyl or carboranyl catalyst.

Further enhancement of a detonability can be achieved by the incorporation of 10–20% of an enhancer bis(difluoroamino) compound, such as 1,2,3-tris[1,2-bis(difluoroamino)ethoxy]propane, TVOPA.

Another enhancer of ultrafinely-ground ammonium perchlorate can serve as a particularly attractive source for oxygen in the oxygen-deficient endosphere or exosphere. The amount of this enhancer as a source for oxygen for inclusion in the fuel catalyst mixture is based on the amount of this source for oxygen required to provide an excess stoichiometric balance of oxygen in the oxygen-deficient atmosphere where employed. Also, this source for oxygen can be employed in combination with a bis(difluoroamino) compound which functions as a further enhancer for detonability.

The concept of this invention of the single-event, unconfined, fuel-air detonation was tested by employing a primary explosive charge of primacord to disperse a catalyst, n-hexylcarborane, carboranylmethyl propionate, ferrocene, or n-butylferrocene into a surround of hydrocarbon fuel, such as, a lower molecular weight alkane (Diesel fuel), which can be modified by inclusion of gelled aluminum or boron powder. The detonation dispersed these materials into the surrounding atmosphere, and it burned like a detonating high explosive.

The composition of the fuel can be modified by the inclusion of aluminum or boron powder which can be suspended in it by means of a gelling agent and/or a thixotropic additive since the metal powders enjoy higher heats of combustion/explosion. Their incorporation will result in a higher order detonation.

The fuel-catalyst can be contained in the same container, although in the laboratory experiments they are kept separate.

Testing of the comparative effectiveness of a single-event detonation system is carried out in the following manner as described in conjunction with the drawing illustrating test device 10 of FIG. 1 and associated parts in FIG. 2. Test device 10 of FIG. 1 comprises a base 28 in which a rod of primacord 12 and explosive charge 14 are mounted as illustrated. A donut shaped housing 13 surrounds explosive charge 14. Housing 13 includes inner steel sleeve 16 and outer steel jacket 18 with chamber 19 of housing 13 being filled with ferrocenyl compound 20. A steel block 26 is mounted on top of bottom block 28 to define donut shaped chamber 22 therebetween. Sleeve 24 connects between blocks 26 and 28 to seal chamber 22. Diesel fuel is placed in chamber 22 by filling through passage 23 that is sealed by removable plug 27. When assembled, detonation of primacord 12 sets off explosive charge 14 and shatters sleeve 16 and jacket 18, and disperses ferrocenyl compound 20 into the diesel fuel contained in vessel chamber 22 which expels the diesel fuel upon rupture of sleeve 24. This rupture occurs rapidly after detonation of primacord 12 and explosive charge 14, and all of these materials are then rapidly dispersed throughout the surrounding atmosphere. Because of the rapidity of the dispersion, the blast wave is sustained. The level at which the blast wave is sustained is strongly influenced by the mass flow generated during the dispersal and combustion.

Figure 1:
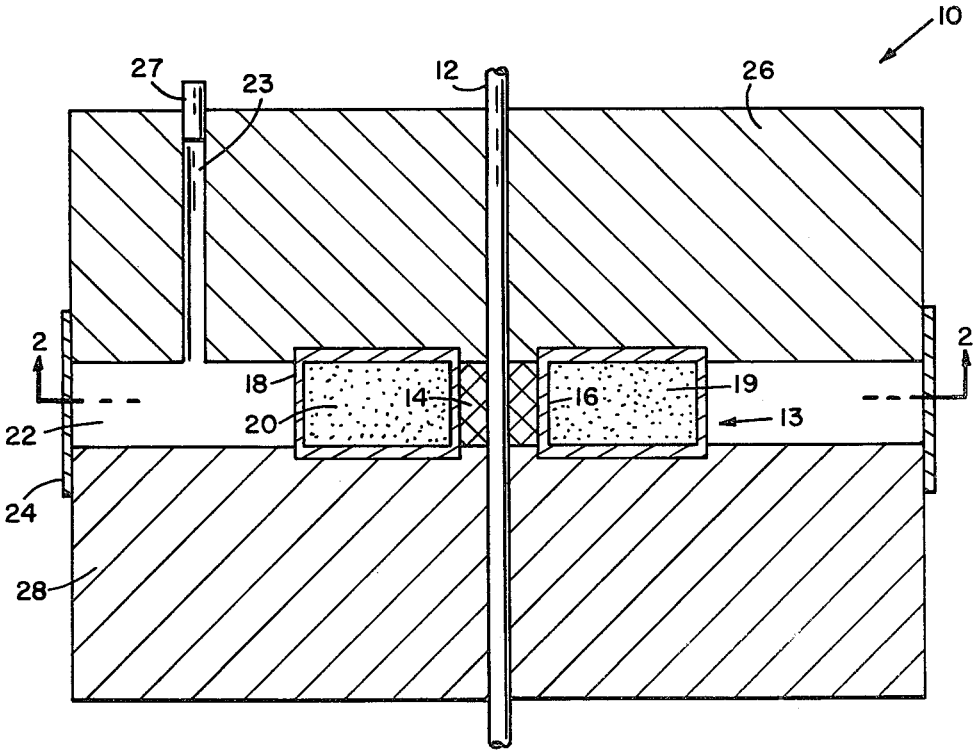
FIG. 1 is a sectional view of a test device used for larger scale testing of a single-event, unconfined fuel-air detonation.

FIG. 2 is a sectional view along line 2—2 of FIG. 1 and partially cut-away to show further details of the device and having like numbers assigned to the same identities of FIG. 1. Preliminary open-air tests were performed in the laboratory by pneumatically driving small slugs of ferrocene into diesel fuel. From practical considerations, the quantity of fuel that was used restricted to volumes of less than 1 ml which is about $10^{-6}$ to $10^{-7}$ times smaller than the fuel quantity that would be used in full-scale systems. At this small scale, the blast generated as a result of fuel dispersal and combustion was estimated to require the ejection of atomized fuel particles into the ambient air to radial distances of the order of 10 cm within less than 300 ms. The ejection momentum that was achieved in these tests did yield a significant augmentation of the blast. When the ambient atmosphere was oxygen instead of air, and the required ejection distance was reduced to the order of 5 cm, the blast effect was increased to the limit of the capability of the test device.

The schematic drawings of the test device used for the larger scale tests are depicted in FIGS. 1 and 2 of the drawing. The test device is comprised of an annular stainless steel vessel containing the ferrocene which is surrounded at its periphery by diesel fuel, and it contained a solid high explosive charge in its core. Confinement for the period between detonation of the charge and ejection of the fluids is obtained by sandwiching the assembly between massive steel blocks shown as 26 and 28 of FIG. 1. The ferrocene-fuel reaction, in conjunction with the primary detonation, drives the fuel into the surrounding atmosphere, forming a cloud of atomized fuel and generating a strong primary shock. The oxygen carried into the cloud by entrainment reacted instantaneously with the fuel, and increased the cloud momentum.

Quantities of reactants used in the full-scale tests were diesel fuel (300 g) and ferrocene (60 g).

The dimensions of this test device were as follows:

Overall diameter: 7 in
Space between steel blocks: $\frac{5}{8}$ in
Ferrocene annulus:
  Outer diameter: 2 in
  Inner diameter: $\frac{1}{2}$ in
Volume of explosive charge: 5 cc
Weight of explosive charge: 8 g

I claim:

1. A method of initiating an unconfined detonation in an atmosphere by a single-event process, said process comprising:

(i) preparing a fuel-catalyst mixture housed in a container, said fuel-catalyst mixture comprised of from about 90 to about 98 weight percent fuel and from about 2 to about 10 weight percent of an initiating chemical catalyst when said detonation is achieved in an oxygen-sufficient atmosphere or in an oxygen-deficient atmosphere, said fuel selected from a volatile liquid of a lower molecular weight alkane or an epoxyalkane, aluminum powder, boron powder, and mixtures thereof, said initiating chemical catalyst selected from n-hexycarborane, carboranylmethyl propionate, ferrocene, and n-butylferrocene, and said fuel-catalyst mixture additionally containing an oxygen source when said detonation is achieved in an oxygen deficient atmosphere;

(ii) dispersing said fuel-catalyst mixture from said container to form a cloud of atomized said fuel and atomized said initiating chemical catalyst, said cloud increasing in momentum as a result of interactions between said fuel, said initiating chemical catalyst, and oxygen carried into said cloud by air entrainment when said detonation is achieved in an oxygen-sufficient atmosphere, and said cloud increasing in momentum as a result of additional interactions between said fuel, said initiating chemical catalyst, and oxygen liberated from said oxygen source when said detonation is achieved in an oxygen-deficient atmosphere, endoatmosphere or exoatmosphere said interactions catalyzed by said initiating chemical catalyst during an induction time period which is the time from the time of said dispersion to the time of the explosion of said cloud, said induction time period controlled by the amount of said initiating chemical catalyst present in said fuel-catalyst mixture, and said explosion of said cloud completing the method of unconfined detonation by said single-event process.

2. The method of claim 1 wherein said fuel-catalyst mixture is prepared by including from about 10 to about 20 weight percent of an additional ingredient which functions as an enhancer for detonability, said enhancer for detonability being 1,2,3-tris[1,2-bis(difluoramino)ethoxy]propane.

3. The method of claim 1 wherein said detonation is achieved in an oxygen-deficient atmosphere, endoatmosphere or exoatmosphere and wherein said fuel-catalyst mixture contains a stoichiometric excess of said oxygen source which is ultrafinely-ground ammonium perchlorate.

4. The method of claim 3 wherein said fuel-catalyst mixture is prepared by including from about 10 to about 20 weight percent of an additional ingredient which functions as a further enhancer for detonability, said further enhancer for detonability being 1,2,3-tris[1,2-bis(difluoroamino)ethoxy]propane.

* * * * *